US011322821B2

(12) United States Patent
Yang

(10) Patent No.: US 11,322,821 B2
(45) Date of Patent: May 3, 2022

(54) ANTENNA REFLECTIVE NET AND ANTENNA REFLECTIVE NET MOUNTING STRUCTURE

(71) Applicant: Ruixiong Yang, Guangzhou (CN)

(72) Inventor: Ruixiong Yang, Guangzhou (CN)

( * ) Notice: Subject to any disclaimer, the term of this patent is extended or adjusted under 35 U.S.C. 154(b) by 362 days.

(21) Appl. No.: 16/314,058

(22) PCT Filed: Apr. 20, 2017

(86) PCT No.: PCT/CN2017/081163
§ 371 (c)(1),
(2) Date: Dec. 28, 2018

(87) PCT Pub. No.: WO2018/036180
PCT Pub. Date: Mar. 1, 2018

(65) Prior Publication Data

US 2019/0319332 A1 Oct. 17, 2019

(30) Foreign Application Priority Data

Aug. 24, 2016 (CN) ..... 201620934744.5

(51) Int. Cl.
*H01Q 1/12* (2006.01)
*H01Q 1/08* (2006.01)
(Continued)

(52) U.S. Cl.
CPC ..... *H01Q 1/12* (2013.01); *H01Q 1/08* (2013.01); *H01Q 15/14* (2013.01); *H01Q 19/17* (2013.01)

(58) Field of Classification Search
CPC H01Q 1/12; H01Q 1/08; H01Q 15/14; H01Q 19/17; H01Q 1/14; H01Q 1/16; H01Q 15/168; H01Q 15/18; H01Q 19/185
See application file for complete search history.

(56) References Cited

U.S. PATENT DOCUMENTS 2,199,050 A * 4/1940 Jenkins ..... H01Q 19/30 343/819
2,535,049 A * 12/1950 De Rosa ..... H01Q 19/04 343/880
(Continued)

FOREIGN PATENT DOCUMENTS

CN 201450101 U * 5/2010 ..... H01Q 1/12
CN 201450101 U 5/2010
(Continued)

OTHER PUBLICATIONS

International Search Report Application No. PCT/CN2017/081163 dated Jul. 12, 2017.

*Primary Examiner* — Dimary S Lopez Cruz
*Assistant Examiner* — Bamidele A Jegede

(57) ABSTRACT

Disclosed are an antenna reflective net and an antenna reflective net mounting structure. Sliding slots are provided on side walls of the antenna reflective net mounting structure respectively. Protrusions of a base of the antenna reflective net slide into the sliding slots, and the size of the sliding slot is adapted to that of the protrusion. The protrusion is fixed in the sliding slot along a direction vertical to the sliding slot. A baffle block is provided at a distal end of the sliding slot. The baffle block restricts the protrusion from sliding along the direction of the distal end. Moreover, a limit part of an elastic pressing member of the antenna reflective net mounting structure restricts the protrusion from sliding along the direction of the entrance end of the sliding slot after the protrusion enters the sliding slot. Therefore, the antenna reflective net is easily mounted in the antenna reflective net mounting structure with high stability.

5 Claims, 7 Drawing Sheets

(51) Int. Cl.
*H01Q 15/14* (2006.01)
*H01Q 19/17* (2006.01)

(56) References Cited

U.S. PATENT DOCUMENTS

| | | | | | |
|---|---|---|---|---|---|
| 2,583,747 | A * | 1/1952 | Potter | H01Q 3/04 | 343/760 |
| 2,688,083 | A * | 8/1954 | Hills | H01Q 5/00 | 343/791 |
| 2,853,706 | A * | 9/1958 | Trench | H01Q 1/081 | 343/880 |
| 5,886,672 | A * | 3/1999 | Brune | H01Q 1/08 | 343/792.5 |
| 6,512,496 | B2 * | 1/2003 | Alexeff | H01Q 1/04 | 343/878 |
| 7,030,829 | B1 * | 4/2006 | McLean | H01Q 11/10 | 174/70 A |
| 7,429,960 | B2 * | 9/2008 | Horiki | H01Q 11/10 | 343/792.5 |
| 7,545,338 | B2 * | 6/2009 | McLean | H01Q 11/10 | 343/792.5 |
| 9,007,271 | B2 * | 4/2015 | Harscher | H01Q 1/081 | 343/792.5 |
| 2004/0145531 | A1 * | 7/2004 | Godard | H01Q 1/1228 | 343/792.5 |
| 2005/0093754 | A1 * | 5/2005 | Lyons | H01Q 1/081 | 343/706 |
| 2010/0101172 | A1 * | 4/2010 | Murphy | H01Q 1/1235 | 52/646 |
| 2012/0019422 | A1 * | 1/2012 | Gemeny | H01Q 1/085 | 343/749 |
| 2012/0024649 | A1 * | 2/2012 | Lai | A45C 5/14 | 190/24 |
| 2012/0170188 | A1 * | 7/2012 | Fan | H05K 5/023 | 361/679.01 |
| 2016/0198847 | A1 * | 7/2016 | Fu | A47B 47/0083 | 211/187 |
| 2018/0019520 | A1 * | 1/2018 | Hildebrand | H01Q 1/081 | |

FOREIGN PATENT DOCUMENTS

| | | | | |
|---|---|---|---|---|
| CN | 201682043 U | * | 12/2010 | H01Q 1/08 |
| CN | 201682043 U | | 12/2010 | |
| CN | 202839905 U | | 3/2013 | |
| CN | 203932297 U | * | 11/2014 | H01Q 1/12 |
| CN | 203932297 U | | 11/2014 | |
| CN | 204289681 U | * | 4/2015 | H01Q 1/10 |
| CN | 204289681 U | | 4/2015 | |
| CN | 105140621 A | | 12/2015 | |
| CN | 205944392 U | | 2/2017 | |

* cited by examiner (a)

(b)

ANTENNA REFLECTIVE NET AND ANTENNA REFLECTIVE NET MOUNTING STRUCTURE

CROSS-REFERENCE TO RELATED APPLICATION

This patent application is a 35 USC § 371 U.S. national stage of International Application No. PCT/CN2017/081163 filed on Apr. 20, 2017, and claims priority under the Paris Convention to Chinese Patent Application Serial No. CN 201620934744.5 filed on Aug. 24, 2016.

TECHNICAL FIELD

The present disclosure relates to the field of outdoor antennas, and more particularly, to an antenna reflective net and an antenna reflective net mounting structure.

BACKGROUND

At present, the outdoor antenna is mostly formed by an antenna element, an antenna main rod and an antenna reflective net. The antenna reflective net includes an antenna reflective net main rod and a plurality of metal cross bars distributed on the antenna reflective net main rod main rod. The antenna element and the antenna reflective net main rod are mounted on the antenna main rod, and the mounting direction of the antenna reflective net main rod is along a direction of the antenna main rod and at an angle with the antenna main rod. In order to reduce the packaging volume and reduce the transportation cost, the outdoor antenna is generally designed as a detachable structure, and components of the outdoor antenna are assembled by the user during use. In the prior art, these components are generally fastened through screws, elastic buckles or other structures, but the assembly and disassembly of these structures are cumbersome.

SUMMARY

The present disclosure aims to provide an antenna reflective net and an antenna reflective net mounting structure. The technical solution of the present disclosure is described as below.

Provided is an antenna reflective net, including: an antenna reflective net main rod and a base, wherein the antenna reflective net main rod is fixedly connected to the base, the base includes a side wall, the side wall of the base is provided with a protrusion, a size of the protrusion is adapted to a size of a sliding slot of the antenna reflective net mounting structure, and contact surfaces of the protrusion and the sliding slot closely fit each other, so that after the protrusion is guided into the sliding slot, the protrusion is fixed in the sliding slot along a direction perpendicular to the sliding slot.

Further, the antenna reflective net main rod and the base are integrally formed.

Further, the side wall of the base includes two opposite side walls, and each of the two side walls is provided with a protrusion.

Provided is an antenna reflective net mounting structure, fixedly connected to an antenna main rod, configured to mount a pair of symmetrically distributed antenna reflective nets, wherein the mounting structure includes a side wall, a sliding slot is disposed on the side wall of the mounting structure, a protrusion of the base of the antenna reflective net is guided into the sliding slot, a size of the sliding slot is adapted to a size of the protrusion, contact surfaces of the protrusion and the sliding slot closely fit each other, the protrusion is fixed in the sliding slot along a direction perpendicular to the sliding slot, a distal end of the sliding slot is provided with a baffle block, the baffle block restricts the protrusion from sliding along a direction of the distal end, the mounting structure further includes an elastic pressing member, the elastic pressing member includes a limit part, and the limit part restricts the protrusion from sliding along a direction of an entrance end of the sliding slot after the protrusion is guided into the sliding slot.

Further, the sliding slot is disposed along a direction of the antenna main rod.

Further, the sliding slot is disposed along a direction perpendicular to the antenna main rod.

Further, the elastic pressing member is an elastic pressing sheet including a button arm and the limit part.

Further, the mounting structure is formed by a first fixing block and a second fixing block, the first fixing block and the second fixing block are fixedly connect to the antenna main rod through screw through holes, and the side wall of the mounting structure includes a side wall of the first fixing block and a side wall of the second fixing block opposite to the side wall of the first fixing block.

Further, there is one elastic pressing member, and the elastic pressing member is disposed on the first fixing block.

Further, each of the side wall of the first fixing block and the side wall of the second fixing block is provided with one sliding slot.

Further, the sliding slot is oriented along a horizontal plane or oriented at an angle to the horizontal plane.

In the present disclosure, a sliding slot is disposed on a side wall of the antenna reflective net mounting structure, a protrusion of a base of the antenna reflective net slides into the sliding slot, the size of the sliding slot is adapted to the size of the protrusion, contact surfaces of the protrusion and the sliding slot closely fit each other, the protrusion is fixed in the sliding slot along a direction perpendicular to the sliding slot, the distal end of the sliding slot is provided with a baffle block, the baffle block restricts the protrusion from sliding in a direction of the distal end, and a limit part of an elastic pressing member of the antenna reflective net mounting structure restricts the protrusion from sliding along a direction of an entrance end of the sliding slot after the protrusion enters the sliding slot. By means of the sliding slot in the present disclosure, the antenna reflecting net is easy to be mounted on the antenna reflective net mounting structure, with a high stability.

DETAILED DESCRIPTION OF THE PREFERRED EMBODIMENT

The present disclosure will be further described in detail below with reference to the accompanying drawings and specific embodiments.

Figure 1:
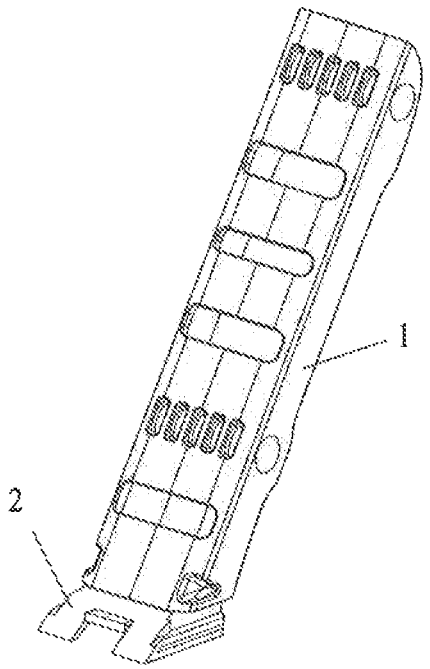
FIG. 1 is a structural diagram illustrating an antenna reflective net according to an embodiment of the present disclosure.
Figure 2:
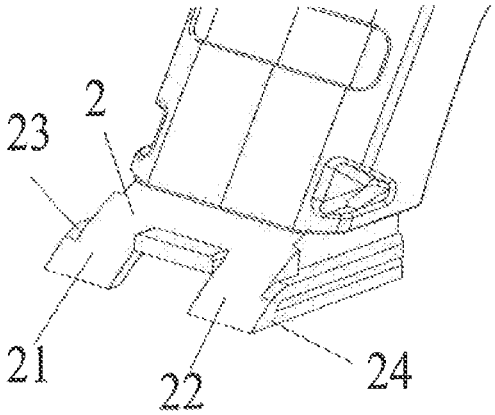
FIG. 2 is a partial enlarged view illustrating a base of the antenna reflective net shown in FIG. 1.

FIG. 1 is an antenna reflective net according to an embodiment of the present disclosure. The antenna reflective net includes an antenna reflective net main rod 1 and a base 2, and the antenna reflective net main rod 1 and the base 2 are integrally formed. FIG. 2 is a partial enlarged view of the base 2 of the antenna reflective net shown in FIG. 1. The base 2 includes two opposite side walls, respectively a side wall 21 and a side wall 22, and each of the side wall 21 and the side wall 22 has a protrusion. The two protrusions are indicated by 23 and 24 respectively in FIG. 1. A size of the protrusion is adapted to a size of the corresponding sliding slot of the antenna reflective net mounting structure, and contact surfaces of the protrusion and the sliding slot closely fit each other, so that after the protrusion is guided into the sliding slot, the protrusion is fixed in the sliding slot along a direction perpendicular to the sliding slot.

Figure 3:
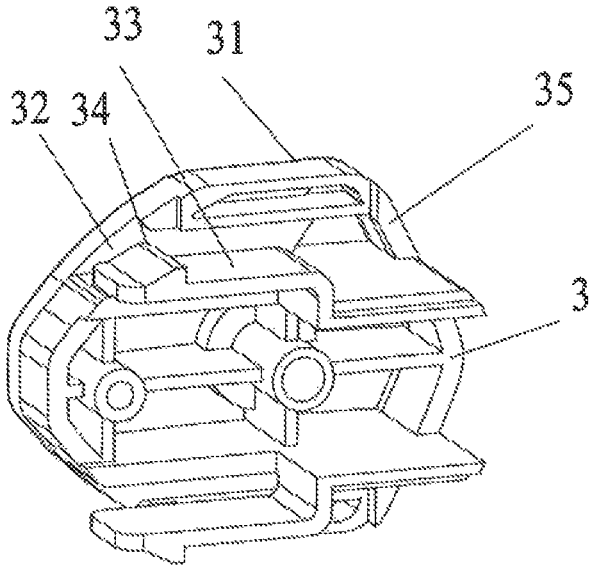
FIG. 3 is a structural diagram illustrating an antenna reflective net mounting structure according to an embodiment of the present disclosure.
Figure 3:
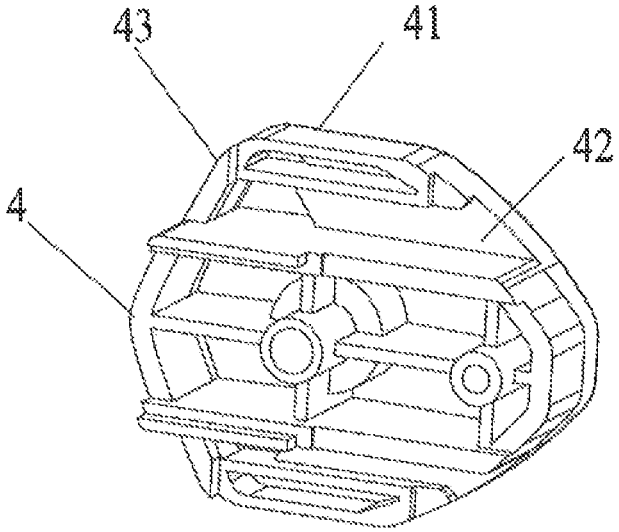
Figure 4:
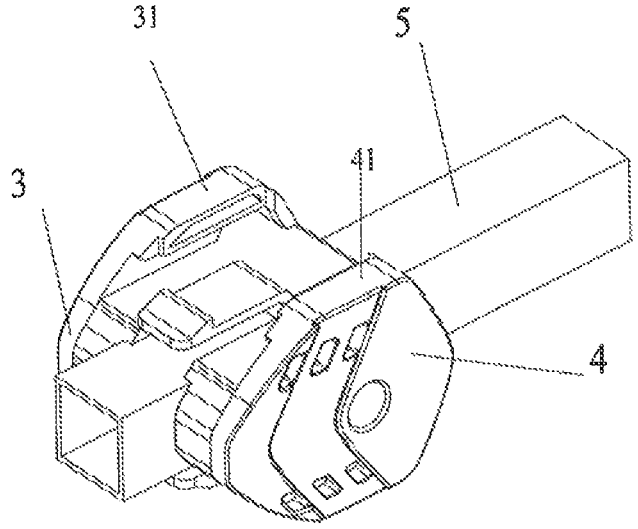
FIG. 4 is a structural diagram illustrating an assembly of an antenna reflective net mounting structure and an antenna main rod according to an embodiment of the present disclosure.

In this embodiment, an antenna reflective net mounting structure for mounting the antenna reflective net of FIG. 1 is also provided. The antenna reflective net mounting structure may be an integral structure, or may be formed by several parts. In this embodiment, as shown in FIG. 3 and FIG. 4, the antenna reflective net mounting structure includes a first fixing block 3 and a second fixing block 4, and the first fixing block 3 and the second fixing block 4 can be fastened to the antenna main rod 5 through the screw through holes. The antenna main rod 5 is placed in a cavity formed by the first fixing block 3 and the second fixing block 4.

In FIG. 3(*a*)(*b*), the side wall of the antenna reflective net mounting structure includes a side wall 31 of the first fixing block 3 and a side wall 41 of the second fixing block 4 opposite to the side wall 31. The side wall 31 is provided with a sliding slot 32, and the side wall 41 is provided with a sliding slot 42. The sizes of the sliding slot 32 and the sliding slot 42 are respectively adapted to the sizes of the protrusion 23 and the protrusion 24, and contact surfaces of each protrusion and the corresponding sliding slot closely fit each other, so that after the protrusion is guided into the sliding slot, the protrusion is fixed in the sliding slot along a direction perpendicular to the sliding slot. The first fixing block 3 is provided with an elastic pressing member. Specifically, the elastic pressing member can be elastic pressing sheet, and the elastic pressing sheet includes a button arm 33 and a limit part 34. The elastic pressing sheet is self-flexible so that it does not hinder the mounting of the antenna reflective net. A distal end of the sliding slot 32 is provided with a baffle block 35, and a distal end of the sliding slot 42 is also provided with a baffle block 43. The baffle block 35 and the baffle block 43 restrict the protrusion from sliding along a direction of the distal end of the sliding slot. The limit part 34 of the elastic pressing sheet can restrict the protrusion form sliding along a direction of an entrance end of the sliding slot after the protrusion is guided into the sliding slot.

It should be noted that antenna reflective nets are generally symmetrically mounted on a same antenna reflective net mounting structure in pairs. Although FIG. 3 and related description only illustrate a configuration required to mount one antenna reflective net in the antenna reflective net mounting structure in detail, a configuration required to mount another antenna reflective net in the antenna reflective net mounting structure is the same. For example, it is necessary to provide a further sliding slot for the another antenna reflective net on the side wall 31 and the side wall 41. A further baffle block may be also provided at the distal end of the sliding slot, and the first fixing block may be also provided with a further elastic pressing member, which will not be described again, and can be understood by referring to FIGS. 3 to 6.

Figure 5:
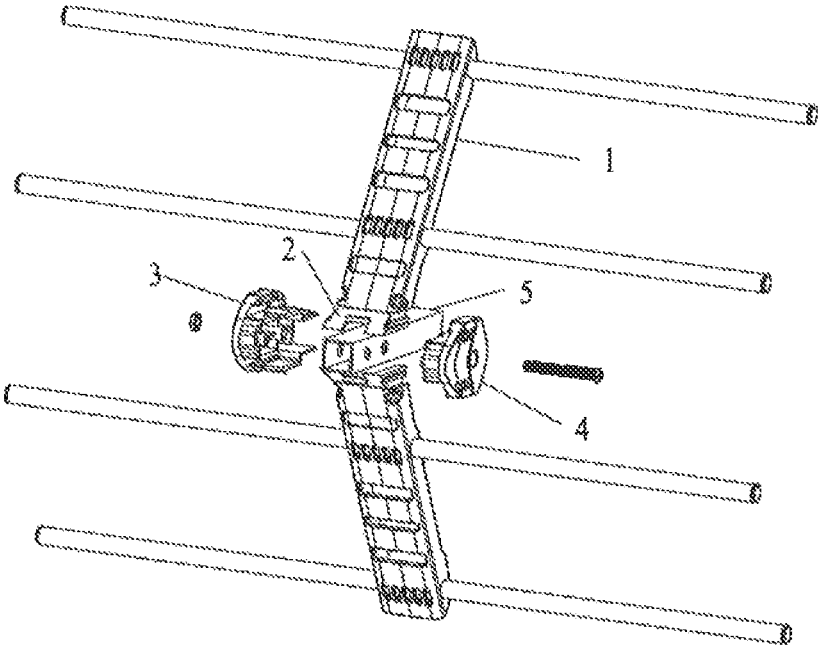
FIG. 5 is an exploded view illustrating the assembly of the antenna reflective net and the antenna reflective net mounting structure in an embodiment of the present disclosure.
Figure 6:
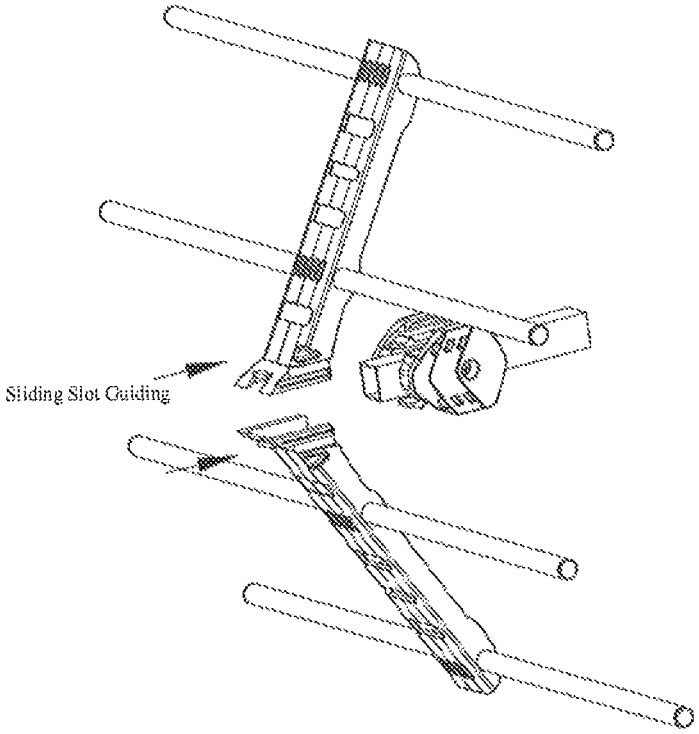
FIG. 6 is a schematic diagram illustrating an assembly process of the antenna reflective net and the antenna reflective net mounting structure in an embodiment of the present disclosure.
Figure 6:
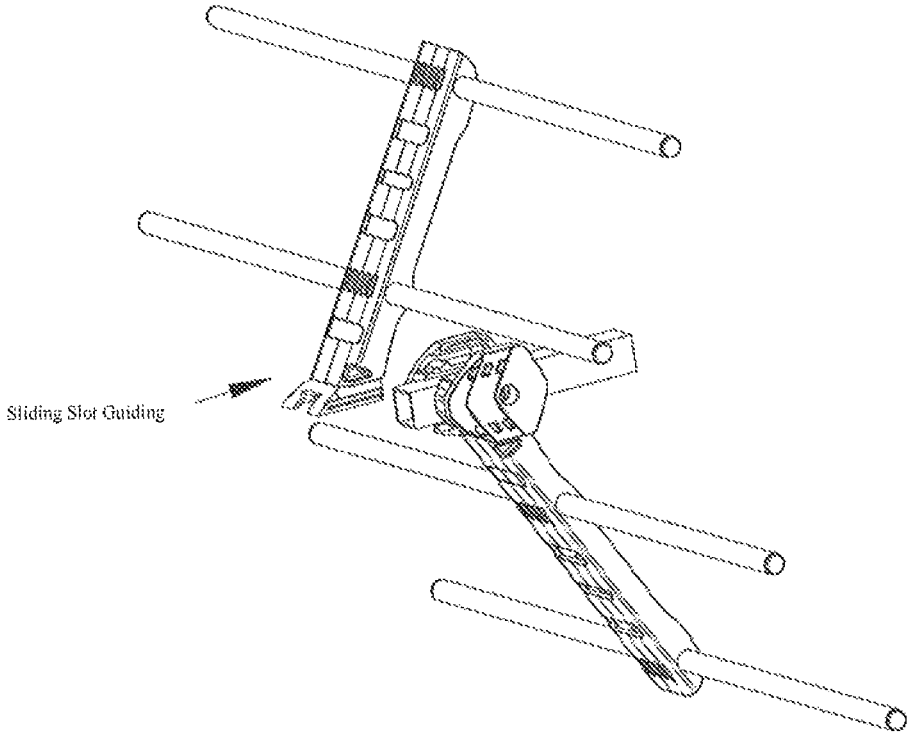
Figure 6:
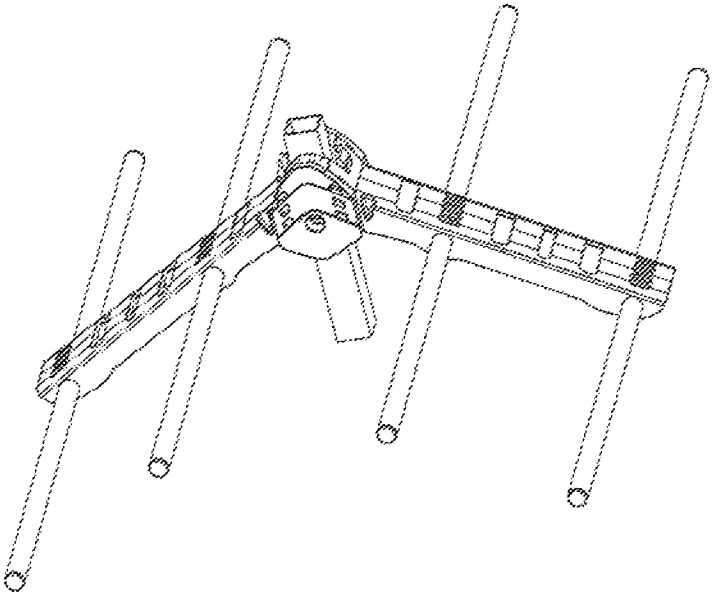

FIG. 5 is an exploded view illustrating the assembly of the antenna reflective net and the antenna reflective net mounting structure, and FIG. 6 is a schematic diagram illustrating an assembly process of the antenna reflective net and the antenna reflective net mounting structure. The first fixing block 3 and the second fixing block 4 fastened to the antenna main rod 5 through the screw through holes, and the antenna main rod 5 is disposed in a cavity formed by the first fixing block 3 and the second fixing block 4. According to the assembly sequence of FIG. 6 (*a*) (*b*) and (*c*). The protrusions of the two side walls of the base 2 of the antenna reflective net are guided into the sliding slots of the first fixing block 3 and the second fixing block 4. After the protrusion is guided into the corresponding sliding slot, contact surfaces of the protrusion and the corresponding sliding slot closely fit each other. One end of the protrusion is blocked by the baffle block at the distal end of the sliding slot, and the other end of the protrusion is restrained by the limit part of the elastic pressing sheet member. The assembly is completed. When the antenna reflective net is required to be disassembled from the antenna reflective net mounting structure, only the limit part of the elastic pressing sheet is required to be pressed, and then the antenna reflective net can slide out from the entrance end of the sliding slot. Therefore, the antenna reflective net can be easily mounted on the antenna reflective net mounting structure, with a high stability.

Figure 7:
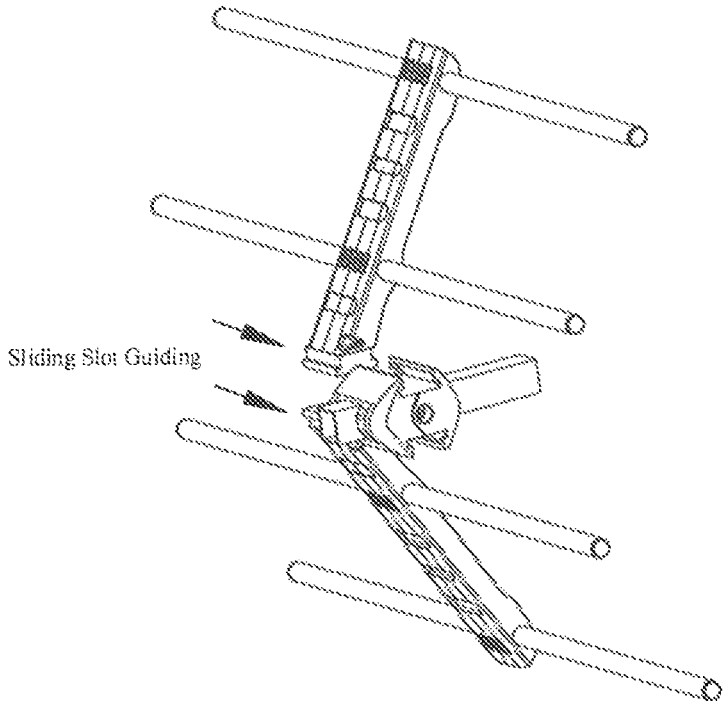
FIG. 7 is a schematic diagram illustrating an assembly process of another antenna reflective net and an antenna transmission net mounting structure in an embodiment of the present disclosure.
Figure 7:
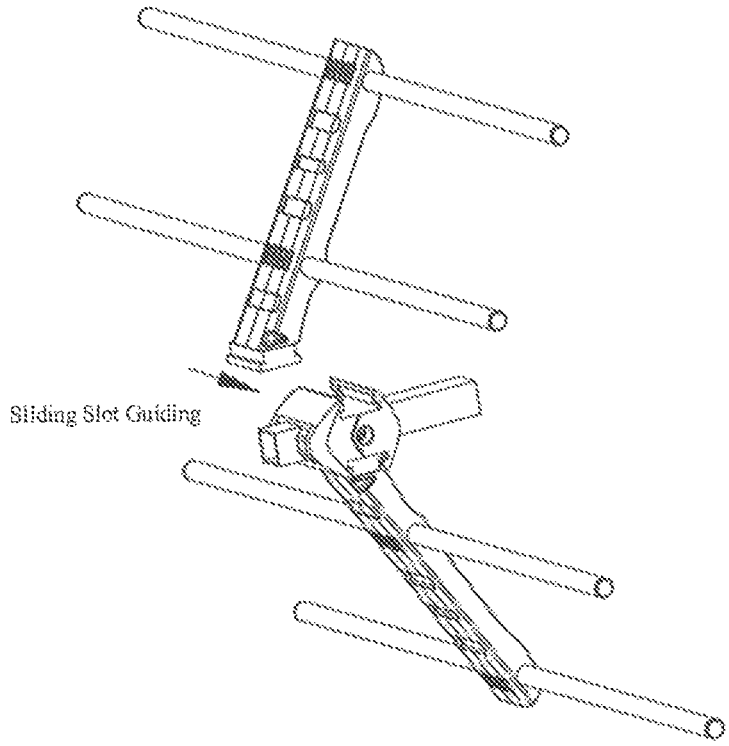
Figure 7:
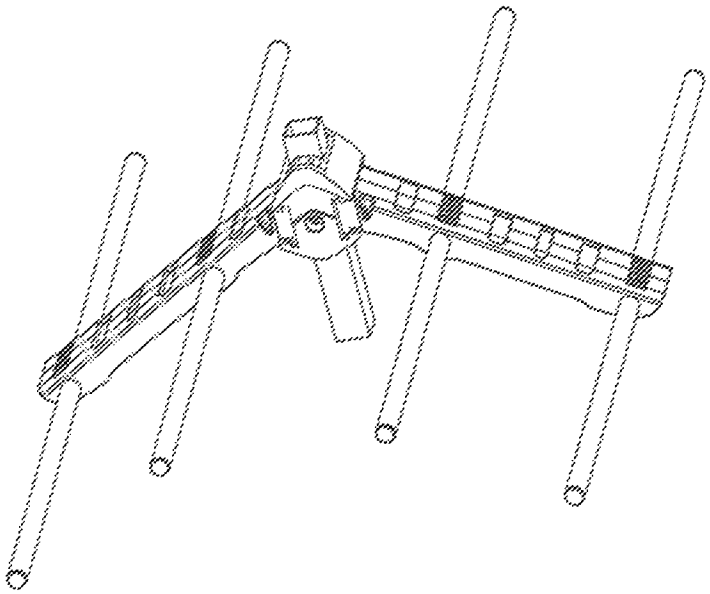

In FIG. 1 to FIG. 6, the direction of the sliding slot of the antenna reflective net mounting structure is arranged along the direction of the antenna main rod, and the base of the antenna reflective net adapted thereto is also designed so that the direction of entering the sliding slot is the direction along the antenna main rod. Of course, the direction of the sliding slot of the antenna reflective net mounting structure can also be arranged along a direction perpendicular to the antenna main rod. FIG. 7 provides a schematic diagram illustrating an assembling process of another antenna reflective net and a antenna reflective net mounting structure adapted thereto. In FIG. 7, the direction of the sliding slot of the antenna reflective net mounting structure is along a direction perpendicular to the antenna main rod, and the base of the antenna reflective net is also adaptively designed so that the direction of the entering sliding slot is perpendicular to the antenna main rod. According to the assembly sequence of FIG. 7 (*a*) (*b*) and (*c*), the antenna reflective net is guided into the antenna reflective net mounting structure along a direction perpendicular to the antenna main rod, and the assembly is completed.

The antenna reflective net and the antenna reflective net mounting structure provided by the embodiments of the present disclosure are described in detail. The configurations and the assembly and disassembly methods of the present disclosure are described herein. The description of the above embodiments are only used to help understand the method and its core idea of the present disclosure. At the same time, for those skilled in the art, according to the idea of the present disclosure, there may be modifications in the specific embodiment. For example, the specific shape of the elastic pressing member may be not limited to elastic pressing sheet, elastic point or elastic block. There may be a plurality of elastic pressing members. The elastic pressing member may be not placed only on the first fixing block. The sliding slot baffle block may be not disposed only at the distal end of each sliding slot. The specific shape of the protrusion may be designed according to requirements. The antenna reflective net main rod and the base may be fixedly connected other than integrally forming. There may be one or more side walls of the antenna reflective net base having the protrusion, and there may be one or more side walls of the antenna reflective net mounting structure having the sliding slot. There may be a plurality of sliding slot on one side wall, and the number of the protrusions may be adjusted based on the number of the sliding slots. The sliding slot may be oriented along a horizontal plane or oriented at an angle to the horizontal plane, that is, the slide path of the protrusion may be horizontal, or may be at an angle to the horizontal plane. In conclusion, the content of the specification should not be construed as limiting the disclosure.

What is claimed is:

1. An antenna reflective net mounting structure, fixedly connected to an antenna main rod, adapted to detachably connect a pair of antenna reflective nets to the antenna main rod such that the pair of antenna reflective nets is symmetrically distributed on the antenna main rod, the antenna reflective net mounting structure comprising:

a first half of the antenna reflective net mounting structure, having a first side wall; and a second half of the antenna reflective net mounting structure, having a second side wall facing the first side wall, wherein the first and second halves are adapted to be fixedly connected to the antenna main rod and fixedly connected to each other to form the whole antenna reflective net mounting structure, wherein a sliding slot is disposed on each of the first side wall and the second side wall, the sliding slot has a size matching a protrusion of a base of each of the antenna reflective nets, and contact surfaces of the protrusion and the sliding slot closely fit each other when the protrusion is introduced into the sliding slot, so that the protrusion is fixed in the sliding slot along a direction perpendicular to the sliding slot, wherein a distal end of the sliding slot is provided with a baffle block, the baffle block restricts the protrusion from sliding along a direction toward the distal end, and wherein the first half comprises an elastic pressing member, the elastic pressing member comprises a limit part, and the limit part restricts the protrusion from sliding along a direction toward an entrance end of the sliding slot after the protrusion is introduced into the sliding slot.

2. The antenna reflective net mounting structure according to claim 1, wherein the sliding slot is disposed along a direction parallel to a length direction of the antenna main rod.

3. The antenna reflective net mounting structure according to claim 1, wherein the sliding slot is disposed along a direction perpendicular to a length direction of the antenna main rod.

4. The antenna reflective net mounting structure according to claim 1, wherein the elastic pressing member is an elastic pressing sheet comprising a button arm and the limit part.

5. The antenna reflective net mounting structure according to claim 1, wherein the sliding slot is oriented along a horizontal plane or oriented at an angle to the horizontal plane.

* * * * *